US009377741B2

(12) United States Patent
Kikuchi

(10) Patent No.: US 9,377,741 B2
(45) Date of Patent: Jun. 28, 2016

(54) IMAGE FORMING APPARATUS HAVING A TRANSFERRING BIAS ADUSTING PART ADJUSTING A TRANSFERRING BIAS ACCORDING TO A SURROUNDING ENVIRONMENT

(71) Applicant: KYOCERA Document Solutions Inc., Osaka (JP)

(72) Inventor: Einosuke Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/816,413

(22) Filed: Aug. 3, 2015

(65) Prior Publication Data

US 2016/0033917 A1 Feb. 4, 2016

(30) Foreign Application Priority Data

Aug. 4, 2014 (JP) ..... 2014-158442

(51) Int. Cl.
*G03G 15/16* (2006.01)
*G03G 15/00* (2006.01)
*G03G 21/20* (2006.01)

(52) U.S. Cl.
CPC ..... *G03G 15/556* (2013.01); *G03G 21/203* (2013.01)

(58) Field of Classification Search
CPC ..... G03G 15/556; G03G 15/1675
USPC ..... 399/66
See application file for complete search history.

(56) References Cited

U.S. PATENT DOCUMENTS 6,006,050 A * 12/1999 Watanabe ..... G03G 15/0822 118/694
7,496,302 B2 * 2/2009 Lane ..... G03G 15/55 347/112
2003/0202806 A1 * 10/2003 Katoh ..... G03G 21/105 399/27
2012/0213535 A1 * 8/2012 Harashima ..... G03G 15/0189 399/44

FOREIGN PATENT DOCUMENTS

JP 09-044003 A 2/1997
JP 09044003 A * 2/1997

* cited by examiner

*Primary Examiner* — Billy Lactaoen
*Assistant Examiner* — Arlene Heredia Ocasio
(74) *Attorney, Agent, or Firm* — Studebaker & Brackett PC

(57) ABSTRACT

An image forming apparatus includes a development device, an electrostatic transfer device, a stopping period measuring part, a driving period measuring part, a toner consumption amount measuring part, an environment measuring part and a transferring bias adjusting part. The driving period measuring part measures a driving period in which the development device is driven in order to form the toner image. The transferring bias adjusting part adjusts the transferring bias on the basis of the stopping period measured by the stopping period measuring part, the driving period measured by the driving period measuring part, the toner consumption amount measured by the toner consumption amount measuring part and the condition of the surrounding environment measured by the environment measuring part.

4 Claims, 4 Drawing Sheets

IMAGE FORMING APPARATUS HAVING A TRANSFERRING BIAS ADUSTING PART ADJUSTING A TRANSFERRING BIAS ACCORDING TO A SURROUNDING ENVIRONMENT

INCORPORATION BY REFERENCE

This application is based on and claims the benefit of priority from Japanese Patent application No. 2014-158442 filed on Aug. 4, 2014, the entire contents of which are incorporated herein by reference.

BACKGROUND

The present disclosure relates to an image forming apparatus transferring a toner image formed on an image carrier onto a recording sheet in an electrostatic transferring manner.

In a case where an electrophotographic image forming apparatus, such as a copying machine or a printer, is left for a long time under a high humidity environment, such as in the summertime or in the rain, without driving, because a toner and a recording sheet are humidified, decrease in image density and disturbance of an image easily occur at a first JOB after starting the driving particularly. In particular, when the toner is humidified, it is feared that a toner charging amount is decreased to deteriorate the image density.

In order to prevent decrease in image density under the high humidity environment, a development device may carry out toner ejecting control or idling control. In the toner ejecting control, the toner in the development device is ejected on an image carrier and the ejected toner is then corrected by a cleaning part. In the idling control of the development device, a developing roller or the like of the development device is idled without forming an electrostatic latent image on the image carrier. Combination of the toner ejecting control and the idling control is particularly effective. However, in the toner ejecting control, a toner amount consumed other than image forming is increased. In the idling control, a user is kept waiting in the idling operation. Thus, either control manner is not a preferable manner for the user.

Thereupon, in an electrostatic transferring device electrostatically transferring the toner image formed on the image carrier onto the recording sheet, in order to adapt for the decreased toner charging amount, a countermeasure applying a transferring bias higher than an ordinary transferring bias is considered.

Alternatively, there is an image forming apparatus configured to control a transferring bias on the basis of a stopping period from finishing of one image forming operation to starting of next image forming operation and temperature near a fixing device.

However, in case of applying the high transferring bias, if an applying time is prolonged, because an electric charge with a reversed polarity to a charged polarity of an image carrier is accumulated inside the image carrier, it is feared that a static eliminator cannot eliminate the electric charge or the image carrier is frictionally worn or damaged.

In a case of controlling the transferring bias on the basis of temperature condition of the fixing device, because humidification condition of the toner is not taken into account, it is impossible to improve decrease in image density under the high humidity environment.

SUMMARY

In accordance with an embodiment of the present disclosure, an image forming apparatus includes a development device forming a toner image on an image carrier, an electrostatic transfer device transferring the toner image onto a recording sheet by a transferring bias, a stopping period measuring part, a driving period measuring part, a toner consumption amount measuring part, an environment measuring part and a transferring bias adjusting part. The driving period measuring part measures a driving period in which the development device is driven in order to form the toner image. The toner consumption amount measuring part measures a toner amount consumed to form the toner image in the development device. The environment measuring part measures a condition of a surrounding environment. The transferring bias adjusting part adjusts the transferring bias applied by the electrostatic transfer device. The transferring bias adjusting part adjusts the transferring bias on the basis of the stopping period measured by the stopping period measuring part, the driving period measured by the driving period measuring part, the toner consumption amount measured by the toner consumption amount measuring part and the condition of the surrounding environment measured by the environment measuring part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, an image forming apparatus according to an embodiment of the present disclosure will be described.

Figure 1:
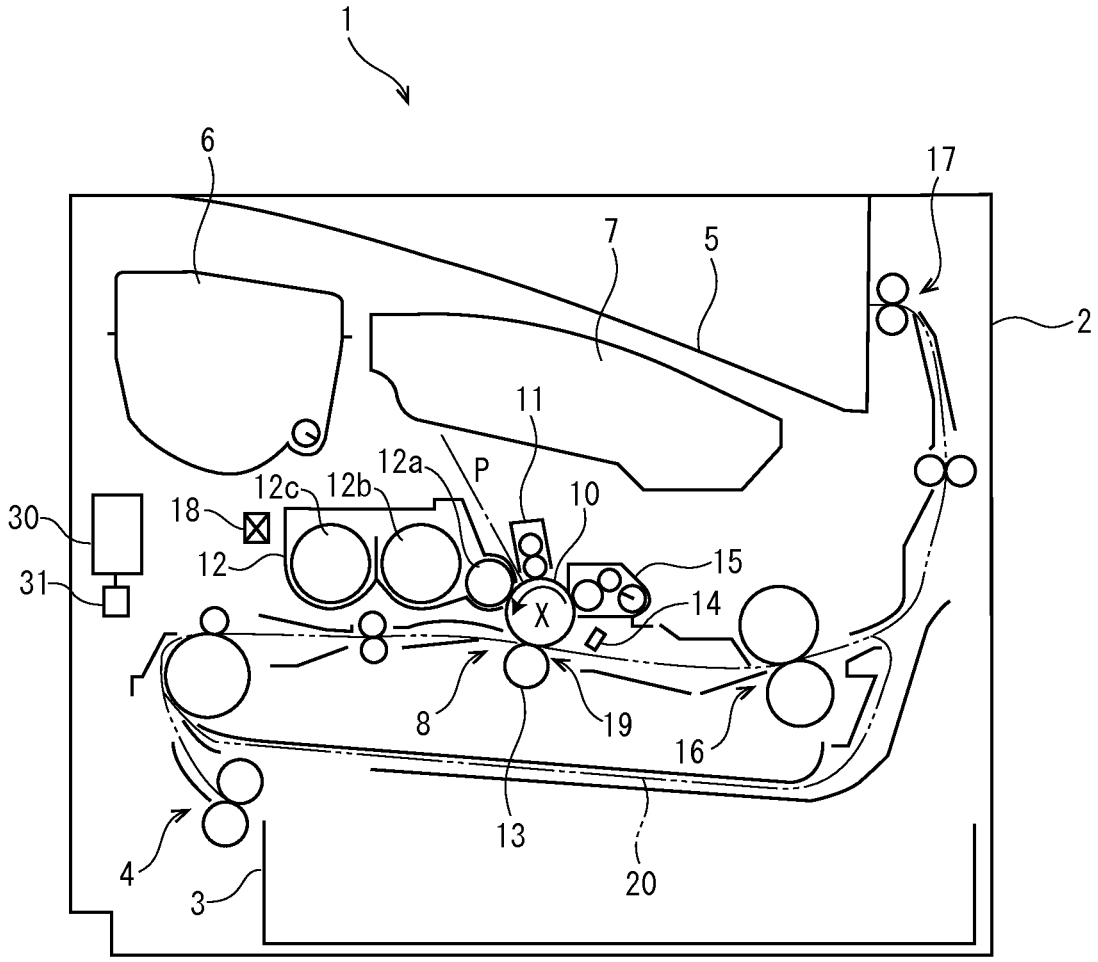
FIG. 1 is a front view schematically showing a printer according to an embodiment of the present disclosure.

First, with reference to FIG. 1, the main structure of the entirety of a printer 1 (an image forming apparatus) will be described. FIG. 1 is a schematic diagram schematically showing the printer according to the embodiment of the present disclosure. In the following description, a near side of FIG. 1 shows a front side of the printer 1 and left and right directions is defined as viewed from the front side of the printer 1.

The printer 1 includes a box-like formed printer main body 2. In a lower part of the printer main body 2, a sheet feeding device 4 feeding a recording sheet from a sheet feeding cartridge 3 storing recording sheets (not shown) is installed. The sheet feeding device 4 is composed of, for example, a pair of sheet feeding rollers. In an upper part of the printer main body 2, an ejected sheet tray 5 is formed. Inside the printer main body 2, a toner container 6 containing a toner is located at an upper side. On a right side of the toner container 6, an exposure device 7 composed of a laser scanning unit (LSU) is located. Below the exposure device 7, an image forming part 8 is provided.

In the image forming part 8, a photosensitive drum as an image carrier is rotatably arranged. The photosensitive drum 10 is, for example, a positively chargeable monolayer photoreceptor. Around the photosensitive drum 10, a charge device 11, a development device 12, a transferring roller 13 (an electrostatic transfer device), a static eliminator 14 and a cleaning device 15 are located in order along a rotating direction (refer to an arrow X in FIG. 1) of the photosensitive drum 10. The charge device 11 is, for example, a contact charging device using a charging roller. The development device 12 includes a developing roller 12*a* carrying a developer and supplying the developer to the photosensitive drum 10 and agitating puddles 12*b* and 12*c* agitating the developer. The developer is, for example, a developer with a positively charged toner. Further, on a right side of the image forming part 8, a fixing device 16 is arranged. Above the fixing device 16, a recording sheet ejecting part 17 is arranged so as to face to the ejected sheet tray 5. In the vicinity of the development device 12, a humidity sensor 18 (an environment measuring part) measurable absolute humidity is arranged.

Inside the printer main body 2, a sheet conveying path 20 passing through a transferring part 19 composed of the photosensitive drum 10 and the transfer roller 13 from the sheet feeding device 4 toward the recording sheet ejecting part 17 is formed.

Moreover, in the printer 1, a controlling part 30 (CPU: Central Processing Unit) is provided. The controlling part 30 is connected to a storing part 31 composed of a storage device, such as a ROM (Read Only Memory) and a RAM (Random Access Memory). The controlling part 30 executes control of each component of the printer 1 on the basis of control program and control data stored in the storing part 31.

Next, image forming operation of the printer 1 including such a configuration will be described. When image data from a computer or the like connected to the printer 1 is inputted to the printer 1, the controlling part 30 controls so as to execute image forming operation as follows.

First, the surface of the photosensitive drum 10 is electrically charged by the charging device 11. Then, photographic exposure corresponding to the image data is carried out to the photosensitive drum 10 by a laser light (refer to a dot chain line P in FIG. 1) from the exposure device 7, thereby forming an electrostatic latent image on the surface of the photosensitive drum 10. The electrostatic latent image is developed to a toner image by the development device 12.

On the other hand, the recording sheet picked up from the sheet feeding cartridge 3 by the sheet feeding device 4 is conveyed to the transferring part 19 in a suitable timing for the above-mentioned image forming operation. In the transferring part 19, a predetermined electrostatic bias is applied to the transferring roller 13 and the toner image on the photosensitive drum 10 is transferred onto the recording sheet. The recording sheet with the transferred toner image is conveyed to a downstream side in the conveying path 20. The recording sheet goes into the fixing device 16, and then, the toner image is fixed on the recording sheet in the fixing device 16. The recording sheet with the fixed toner image is ejected from the recording sheet ejecting part 17 to the ejected sheet tray 5. An electrical potential remained on the photosensitive drum 10 is electrically discharged by the electric eliminator 14. The toner remained on the photosensitive drum 10 is collected by the cleaning device 15.

Figure 2:
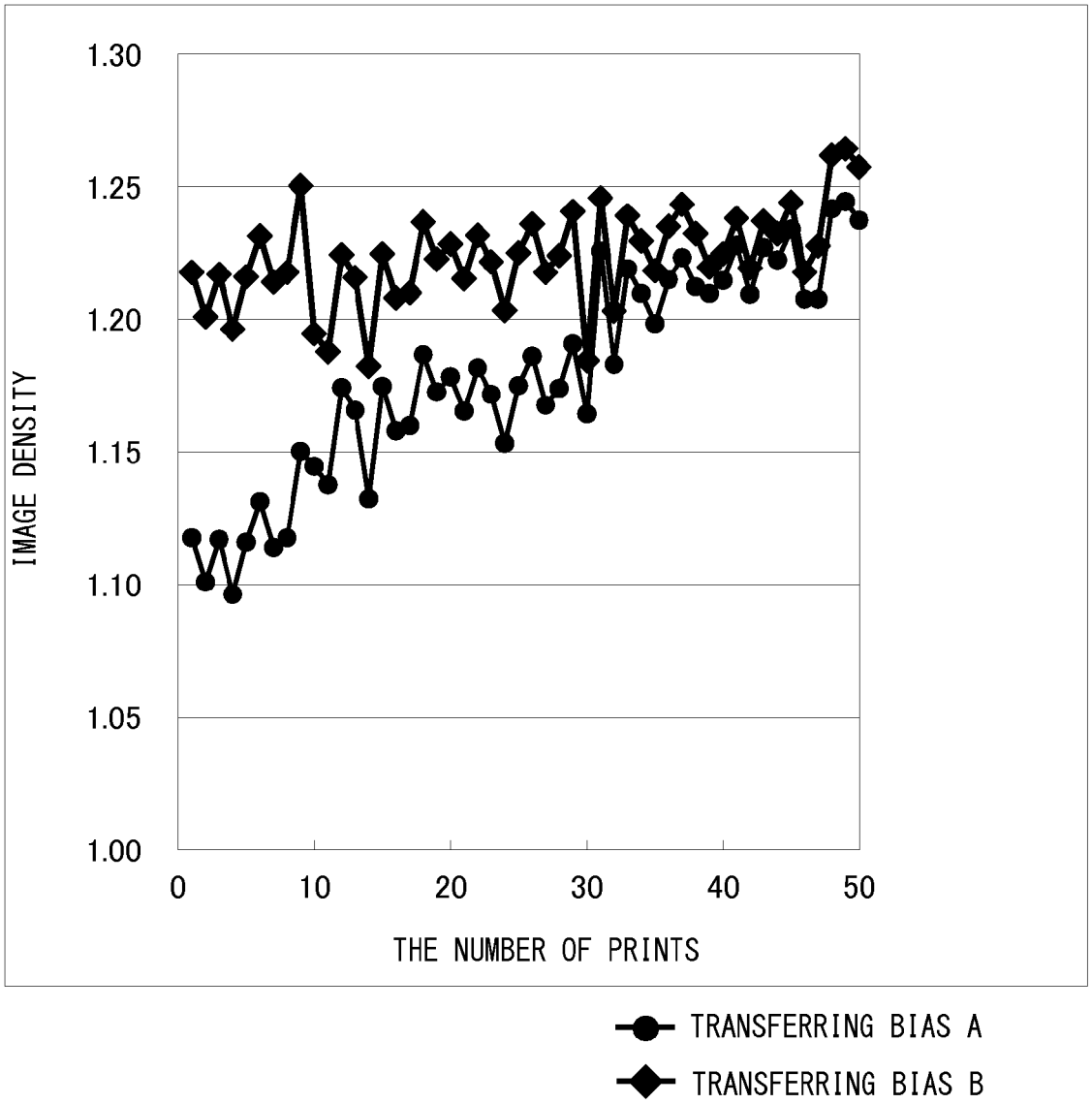
FIG. 2 is a graph plotting relationship of image density and the number of prints in the printer according to the embodiment of the present disclosure.

Next, with reference to FIG. 2, relationship between a transferring bias applied to the transferring roller 13 and image density will be described. FIG. 2 is a graph showing a measured image density when image forming is started after the printer is left under a high humidity environment. In the graph, a vertical axis indicates the image density measured by a reflection densitometer and a horizontal axis indicates the number of prints. In the graph, a solid line plotted by black circles indicates a measured result when applying a low transferring bias (a transferring bias A) and a solid line plotted by black rhombuses indicates a measured result when applying a high transferring bias (a transferring bias B).

In a case of the transferring bias A, the image density is as low as around 1.10 at an early stage of print starting and becomes higher as the number of prints increases. When the number of prints exceeds 30 prints, the image density is stabilized in a range within 1.20-1.25. On the other hand, in a case of the transferring bias B, the image density is stabilized in a range within 1.20-1.25 from an early stage of print starting.

From this graph, it is shown that, in a case where the transferring bias is low (in the case of the transferring bias A), the image density is insufficient under the high humidity environment in a period from the print starting until the image forming operation is carried out by a predetermined number of prints (in this example, 30 prints); the image density becomes gradually higher as the image forming operation is repeated and then is roughly stabilized when the number of the image forming operation exceeds the predetermined number of prints. That is, even under the high humidity environment, when the development device 12 carries out the toner image forming operation for a predetermined driving time or when a predetermined amount of the toner is consumed (in the graph of FIG. 2, when image forming operation is carried out by approximately 30 prints), even if the transferring bias is low, it is possible to solve humidification condition of the toner and to obtain a desired image density.

Figure 3:
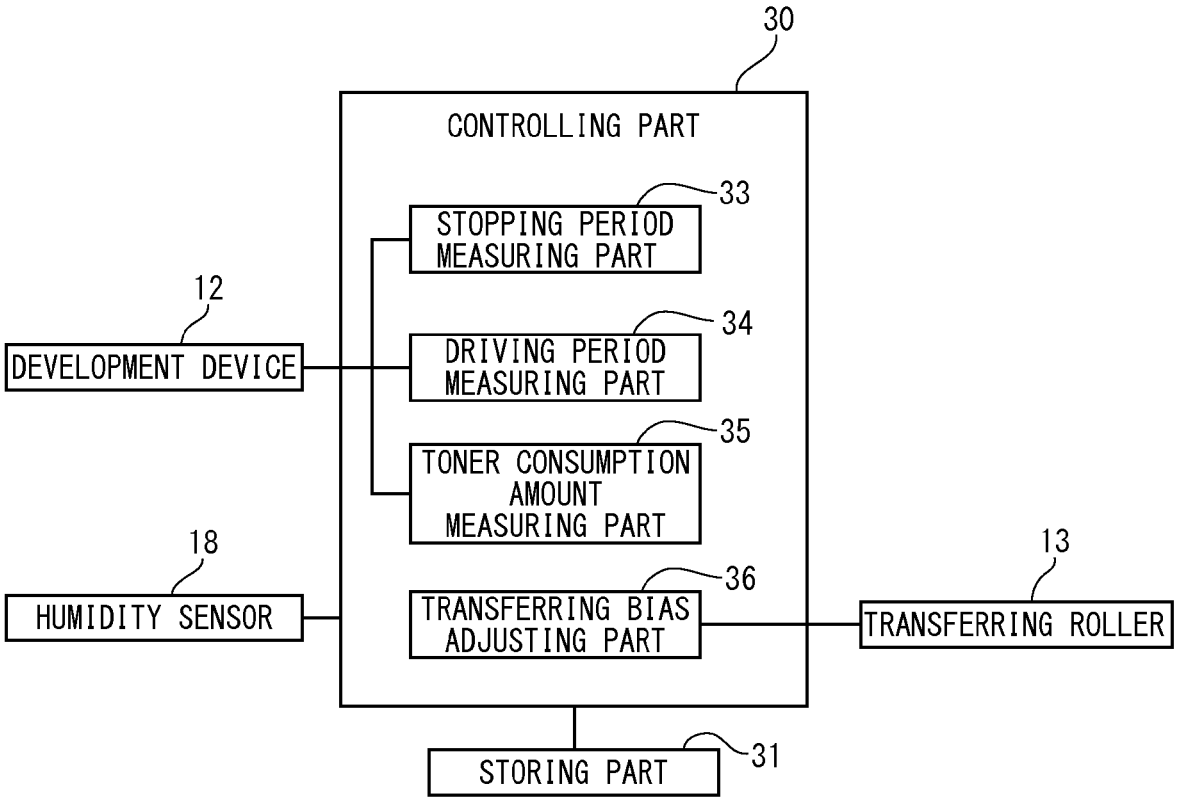
FIG. 3 is a block diagram showing a controlling part in the printer according to the embodiment of the present disclosure.

Next, with reference to FIG. 3, the controlling part 30 will be described. FIG. 3 is a block diagram showing the controlling part.

The controlling part 30 includes a stopping period measuring part 33, a driving period measuring part 34, a toner consumption amount measuring part 35 and a transferring bias adjusting part 36. The stopping period measuring part 33 measures a stopping period from finishing of one image forming operation to starting of next image forming operation. The driving period measuring part 34 measures a driving period in which the development device 12 is driven in order to form the image. The toner consumption amount measuring part 35 measures a toner amount consumed in the image forming operation in the development device 12. The transferring bias adjusting part 36 adjusts the transferring bias applied to the transferring roller 13.

The stopping period measuring part 33 measures, for example, a period from a stop time when the rotation of the developing roller 12*a* or the agitating puddles 12*b* and 12*c* of the development device 12 is stopped to a start time when the next rotation of the developing roller 12*a* or the agitating puddles 12*b* and 12*c* is started. The driving period measuring part 34 measures, for example, in one image forming operation, a period from a start time when a rotation of the developing roller 12*a* or the agitating puddles 12*b* and 12*c* of the development device 12 is started to a stop time when the rotation of the developing roller 12*a* or the agitating puddles 12*b* and 12*c* is stopped. The toner consumption amount measuring part converts, for example, processed image data into a toner consumption amount in one image forming operation.

The transferring bias adjusting part 36 sets the transferring bias applied to the transferring roller 13 to the transferring bias A or the transferring bias B. The transferring bias A is a standard electrostatic bias applied to the transferring roller 13 under an ordinary environment and may be −20 μA as an example. The transferring bias B is an electrostatic bias capable of obtaining a suitable image density at an early stage of print starting when the operation of the printer 1 is started after the printer 1 is left under the high humidity environment, as described with reference to FIG. 2. The transferring bias B has an absolute value larger than the standard electrostatic transferring bias A and may be −40 μA as an example.

In the storing part 31, an absolute humidity as a criterion for decision whether an absolute humidity measured by the humidity sensor 18 is a high humidity is stored. The absolute humidity as the criterion for decision of the high humidity environment is, for example, 15 g/m$^3$. Further, in the storing part 31, a criterion stopping period as a criterion for decision whether a stopping period measured by the stopping period measuring part 33 is a period elapsed after the printer 1 is left until a possibility of humidifying the toner is high is stored. The stopping period as the criterion for decision that the possibility of humidifying the toner is high is, for example, 12 hours.

Further, in the storing part 31, a criterion driving period (a criterion driving period X sec) as a criterion for decision whether a driving period measured by the driving period measuring part 34 is a period for the idling operation of the development device 12 under a humidification condition of the toner in development device 12 until the humidification condition of the toner is solved is stored. In the storing part 31, a criterion amount of consumed toner (a criterion toner consumption amount Y mg) as a criterion for decision whether a toner consumption amount measured by the toner consumption amount measuring part 35 is a toner amount consumed for the image forming operation of the development device 12 under a humidification condition of the toner in development device 12 until the humidification condition of the toner is solved is stored.

Moreover, in the storing part 31, an accumulation driving period accumulated the driving period measured by the driving period measuring part 34 and an accumulation toner consumption amount accumulated the toner consumption amount measured by the toner consumption amount measuring part 35 are stored. Further, in the storing part 31, the transferring bias A and the transferring bias B are stored.

Figure 4:
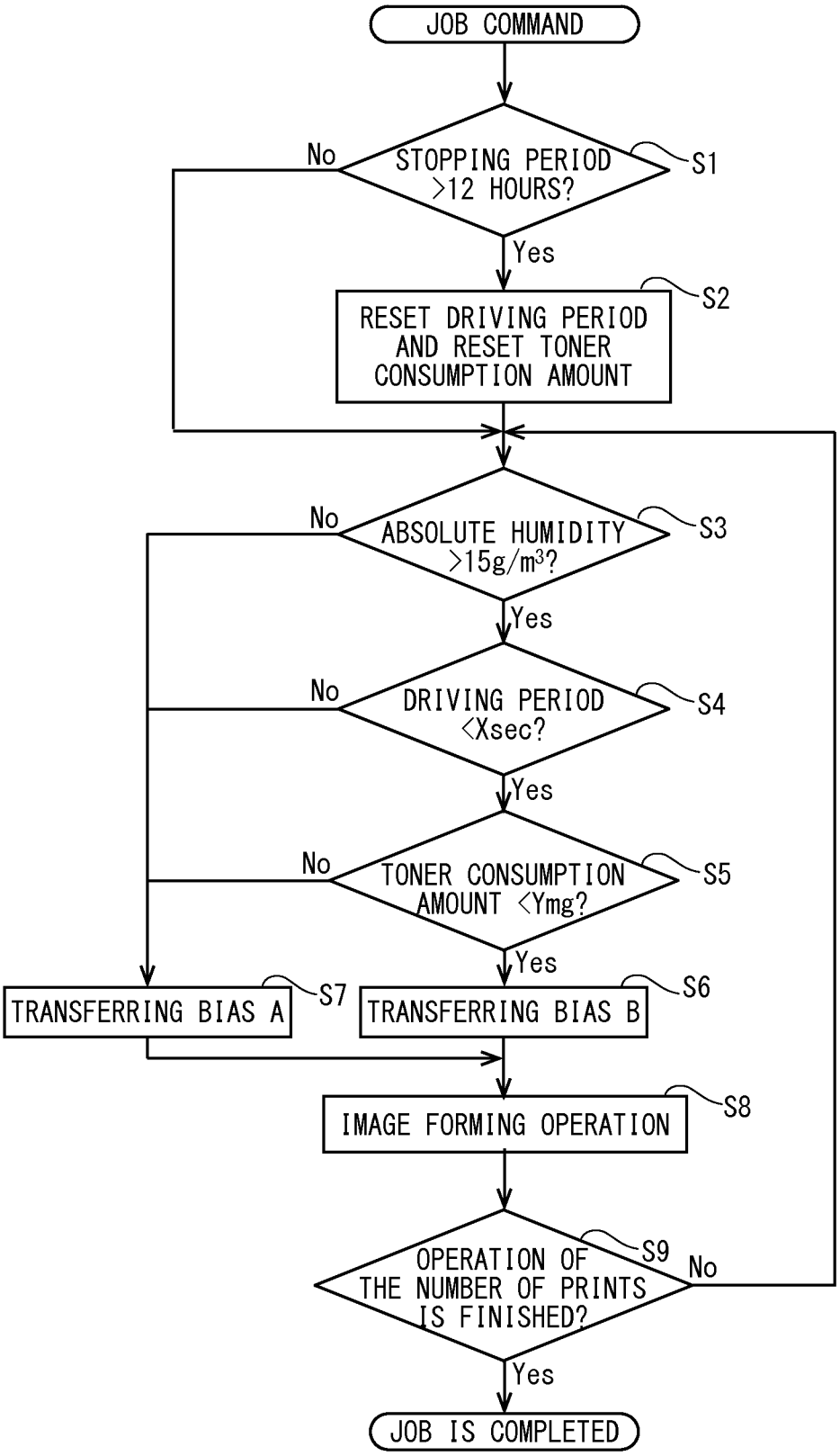
FIG. 4 is a flowchart useful for understanding a transferring bias adjusting manner of the controlling part in the printer according to the embodiment of the present disclosure.

With reference to a flowchart of FIG. 4, an adjusting manner of the transferring bias in the controlling part 30 will be described.

When a JOB command, such as inputting of image data and the number of prints, from the computer or the like connected to the printer 1 is inputted to the printer 1, the controlling part 30 decides at step S1 whether or not the stopping period measured by the stopping period measuring part 33 is longer than 12 hours as the reference stopping period.

As a result, if it is decided that the stopping period is longer than 12 hours, processing is advanced to step S2. At step 2, the controlling part 30 resets (zeroizes) data of the accumulation driving period and the accumulation toner consumption amount, which are stored in the storing part 31, at a time when the last image forming operation is finished and processing is advanced to step S3. On the other hand, at step S1, if it is decided that the stopping period is 12 hours or less, the data of the accumulation driving period and the accumulation toner consumption amount stored in the storing part 31 is continuously used as values to be decided and processing is advanced to step S3.

At step S3, the controlling part 30 decides whether or not the absolute humidity measured by the humidity sensor 18 is higher than 15 g/m$^3$ as a decision criterion of the high humidity environment stored in the stored part 31.

As a result, if it is decided that the absolute humidity is higher than 15 g/m$^3$, processing is advanced to step S4. At step S4, the controlling part 30 decides whether or not the accumulation driving period is shorter than the criterion driving period X sec, stored in the storing part 31, capable of solving toner humidification condition. Subsequently, if it is decided that the accumulation driving period is shorter than the criterion driving period X sec, processing is advanced to step S5.

At step S5, the controlling part 30 decides whether or not the accumulation toner consumption amount is less than the criterion toner consumption amount Y mg, stored in the storing part 31, capable of solving toner humidification condition. Subsequently, if it is decided that the accumulation toner consumption amount is less than the criterion toner consumption amount Y mg, processing is advanced to step S6.

At step S6, in the controlling part 30, the transferring bias adjusting part 36 sets the transferring bias applied to the transferring roller 13 to the transferring bias B.

On the other hand, if it is decided at step S3 that the absolute humidity is 15 g/m$^3$ or less, or if it is decided at step S4 that the accumulation driving period is X sec or more, or it is decided at step S5 that the accumulation toner consumption amount is Y mg or more, processing is advanced to step S7.

At step S7, in the controlling part 30, the transferring bias adjusting part 36 sets the transferring bias applied to the transferring roller 13 to the transferring bias A.

At step S6 or step S7, when either transferring bias is set, processing is advanced to step S8 and the controlling part 30 controls each components so as to start the image forming operation of first print. When the image forming operation is carried out at step S8, the driving period measuring part 34 measures a period for driving the development device 12 in order to form the image and the measured period is accumulated into the accumulation driving period. Further, the toner consumption amount measuring part 35 measures the toner amount consumed in this image forming operation and the measured toner amount is accumulated into the accumulation toner consumption amount. When the image forming operation of the first print is finished at step S8, processing is advanced to step S9. At step S9, the controlling part 30 decides whether or not the image forming operation for the inputted number of prints is finished.

As a result, if it is decided that the image forming operation for the inputted number of prints is finished, the JOB is completed. On the other hand, if it is decided that the image forming operation for the inputted number of prints is not finished, processing is returned to step S3 and the processes (steps S3-S8) in the above-mentioned flow are carried out.

In the printer 1 including the above-described configuration, after it is decided that the surrounding environment is the high humidity environment (step S3: Yes), when the image forming operation is repeated and the driving period of the development device 12 becomes the criterion driving period X sec or more (step S4: No), it is decided that the toner humidification condition is solved and then the transferring bias is set to a low value (the transferring bias A) (step S7). In addition, when the image forming operation is repeated and the toner consumption amount becomes the criterion toner consumption amount Y mg or more (step S5: No), it is decided that the toner humidification condition is solved and the transferring bias is set to a low value (the transferring bias A) (step S7). That is, even if a high transferring bias is needed at the early stage of the JOB under the high humidity environment, it is possible to change the transferring bias into the low value when it is decided that the toner humidification condition is solved in the middle of the JOB.

As described above, in the printer 1 according to the embodiment of the present disclosure, in a case where a first JOB is carried out under the high humidity environment, when the development device 12 repeats the image forming operation and it is decided that the toner humidification condition is solved, it is possible to set the transferring bias into the low value in the middle of the JOB. For example, in a case where the surrounding environment is the high humidity environment, if the number of prints using the high transferring bias were fixed, because the high transferring bias must be applied regardless of the toner humidification condition until the fixed number of prints is reached, the photosensitive drum 10 may continuously receive constant damage. However, in the embodiment, even if the high transferring bias is needed at the early stage under the high humidity environment, when it is decided that the toner humidification condition is solved, it is possible to immediately return the transferring bias into the low value regardless of the number of prints. Therefore, it is possible to obtain desired image density at the early stage under the high humidity environment, and moreover, since a period for applying the high transferring bias is reduced, it is possible to reduce discharge failure of the photosensitive drum 10 and damage received by the photosensitive drum 10.

In addition, if the stopping period of the development device 12 is longer than 12 hours, since the data of the driving period and the toner consumption amount is reset (step S2), the high transferring bias B is applied to a first print after starting the driving of the printer 1 under the high humidity environment. That is, if the stopping period is longer than 12 hours, assuming that the possibility of humidifying the toner is high, by applying the high transferring bias B after starting the driving of the printer 1 under the high humidity environment, it is possible to prevent decrease in image density after starting the driving of the printer 1.

Although, in the embodiment, the high humidity environment is decided in a case where the absolute humidity is higher than 15 g/m$^3$, the absolute humidity as the decision criterion may be determined according to a placement environment or using condition of the printer 1. Further, although, in the embodiment, the humidity sensor 18 is located in the vicinity of the development device 12, the humidity sensor 18 may be located at another position. For example, it may be located at a room where the printer 1 is placed. In such a case, the absolute humidity as the decision criterion may be a different value from 15 g/m$^3$.

In addition, amperage of the transferring bias A and the transferring bias B, the criterion driving period X sec as the decision criterion of the driving period or the criterion toner consumption amount Y mg as the decision criterion of the toner consumption amount may be determined according to a placement environment or using condition of the printer 1 and may be changed at any time as necessary.

Further, although, in the embodiment, the transferring bias is adjusted by two stages of the low transferring bias A and the high transferring bias B in accordance with the toner humidification condition, more detail decision criterion is provided and the transferring bias may be adjusted by three or more stages.

Incidentally, although the embodiment is configured so that processing is returned to step S3 whenever the image forming operation of one recording sheet is carried out and processes of steps S3-S8 are carried out, processes of steps S3-S8 may be carried out for a plurality of sheets (e.g. 2 sheets or 5 sheets) in a case of the JOB with the large number of prints.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a development device forming a toner image on an image carrier that is a positively chargeable monolayer photoreceptor;

an electrostatic transfer device transferring the toner image formed on the image carrier onto a recording sheet by applying a transferring bias;

a stopping period measuring part measuring a stopping period from finishing of one image forming operation to starting of next image forming operation in the development device;

a driving period measuring part measuring a driving period in which the development device is driven in order to form the toner image;

a toner consumption amount measuring part measuring a toner amount consumed to form the toner image in the development device;

an environment measuring part measuring a condition of a surrounding environment; and a transferring bias adjusting part adjusting the transferring bias applied by the electrostatic transfer device, wherein the transferring bias adjusting part adjusts the transferring bias on the basis of the stopping period measured by the stopping period measuring part, the driving period measured by the driving period measuring part, the toner consumption amount measured by the toner consumption amount measuring part and the condition of the surrounding environment measured by the environment measuring part, wherein the environment measuring part measures humidity in the vicinity of the development device, wherein the transferring bias adjusting part adjusts the transferring bias into a high value, in a case where it is decided that the surrounding environment is a high humidity environment on the basis of the condition of the surrounding environment measured by the environment measuring part, if the driving period measured by the driving period measuring part is shorter than a criterion driving period and the toner consumption amount measured by the toner consumption amount measuring part is less than a criterion toner consumption amount, and wherein the transferring bias adjusting part adjusts the transferring bias into a high value, in a case where the stopping period measured by the stopping period measuring part is longer than a criterion stopping period, if it is decided that the surrounding environment is a high humidity environment on the basis of the condition of the surrounding environment measured by the environment measuring part.

2. The image forming apparatus according to claim 1, wherein the criterion period is a period in which the development device is idled until a toner humidification condition is solved.

3. The image forming apparatus according to claim 1, wherein the criterion amount is a toner amount consumed when the development device carries out the image forming operation under a high humidity environment until a toner humidification condition is solved.

4. The image forming apparatus according to claim 1, wherein if it is decided that the stopping period is longer than the criterion stopping period, data of the accumulated driving period and the accumulated toner consumption amount are reset.

* * * * *